United States Patent [19]

Ragan

[11] 4,283,057

[45] Aug. 11, 1981

[54] WHISTLING GOLF CLUB

[76] Inventor: James T. Ragan, 473 Thayer Pond Rd., Wilton, Conn. 06897

[21] Appl. No.: 184,392

[22] Filed: Sep. 5, 1980

Related U.S. Application Data

[63] Continuation-in-part of Ser. No. 80,061, Sep. 28, 1979, abandoned.

[51] Int. Cl.[3] ..... A63B 69/36

[52] U.S. Cl. ..... 273/186 A; 46/177

[58] Field of Search ..... 273/186 A, 162 R, 193 R, 273/194 A, 183 D; 46/177

[56] References Cited

U.S. PATENT DOCUMENTS 1,549,350 8/1925 Deike ..... 273/186 A

FOREIGN PATENT DOCUMENTS 1195408 5/1959 France ..... 273/186 A

*Primary Examiner*—George J. Marlo

*Attorney, Agent, or Firm*—Kenyon & Kenyon

[57] ABSTRACT

A golf club has an air flow hole through its head and the hole contains a whistle so that when the club is swung, the sound of the whistle provides an indication of the smoothness and velocity of the swing. The ambient air becomes locally turbulent at the hole's outlet end when the head swings. A tailpipe extends from the hole's outlet to a position where the ambient air is relatively free from such turbulence. The club head may include two whistles. The first whistle is actuated by air entering an aperture on the striking face of the club head. The second whistle is actuated by centrifugally driven air moving down the club shaft.

7 Claims, 6 Drawing Figures

WHISTLING GOLF CLUB

BACKGROUND

This application is a continuation-in-part of application Ser. No. 80,061 filed Sept. 28, 1979, now abandoned.

Golf clubs intended to assist golfers in improving the smoothness and velocity with which they swing a golf club have been suggested by prior art inventors.

The general approach has been to form a hole through the golf club head or a head attachment, and position a reed organ or a whistle in the hole, the idea being that when the golf club is swung, the ambient air compressed by the swinging movement should provide an air flow through the hole actuating the organ or whistle so that it gives a sound indicative of the way the club is swung.

For such a golfer's swing training golf club to be effective and commercially saleable, it must produce an accoustical signal that is truly indicative of the smoothness and velocity of the golf club swing, and the signal must be easily audible over possibly high-level background noise. Known designs have been inadequate in this respect.

A substantial improvement is provided by the golfer's club swing trainer of application Ser. No. 80,061. In this case the golf club head is provided with an air flow hole having an inlet at the face of the club and extending through the head to an outlet end at the back of the club, the hole containing a whistle actuated by the air flow through the hole when the club is swung. The hole's outlet end is provided with a tailpipe extending backwardly beyond the back of the club head. In this way an increased sound intensity is obtained when the club is swung, because the tailpipe opens beyond localized air turbulence inherently created behind the swinging head. With the tailpipe extending from the hole's outlet end to a position where the ambient air is relatively free from such turbulence, the whistle can function as intended.

SUMMARY

According to the present invention, the previous hole, whistle and tailpipe combination can be retained. Independently of this combination the club head is provided with a second air flow hole and whistle and a means actuated by swinging of the club for forcing air into the inlet end of this second hole.

To do this, the golf club with the tubular shaft which performs its usual function of mounting the golf club head, is modified so that its upper end is open to the ambient atmosphere. The second air flow hole has an inlet end internally within the golf club head and the lower end of the tubular shaft connects to this hole. To avoid interference with the first hole, the second hole is transversely positioned so as to have an outlet end through the side of the head. The two holes are vertically offset from each other. With this second hole containing a whistle, swinging of the golf club centrifugally drives the air in the golf club shaft down into and through the inlet end of the second hole so as to actuate the whistle in this hole. Ambient air flows into the shaft's open upper end. With the two whistles having the same musical pitch, the overall sound intensity obtained is substantially increased.

If this second hole and tubular shaft arrangement is used alone, without the first hole and whistle, the golf club is capable of actual practical use as a golf club because there is then no hole in the face of the club head. To provide further increased sound level, this second or transversely extending hole through the club head can be also provided with a tailpipe because it has been found that the localized turbulence in the ambient air caused by club swinging, also prevails on the side of the club head. The tailpipe extends transversely from the club head and should reach at least behind the area of the most intense turbulence around the side of the golf club head.

The present invention permitting the use of what might be called tandem whistles, provides a golfer's club swing trainer which when swung produces a sound output so loud as to impress even the most demanding of the purchasing public.

BRIEF DESCRIPTION OF THE DRAWINGS

The accompanying drawings illustrate the present invention, and in which.

DETAILED DESCRIPTION OF THE INVENTION

Figures 1, 2, 3, 4, 5, 6:
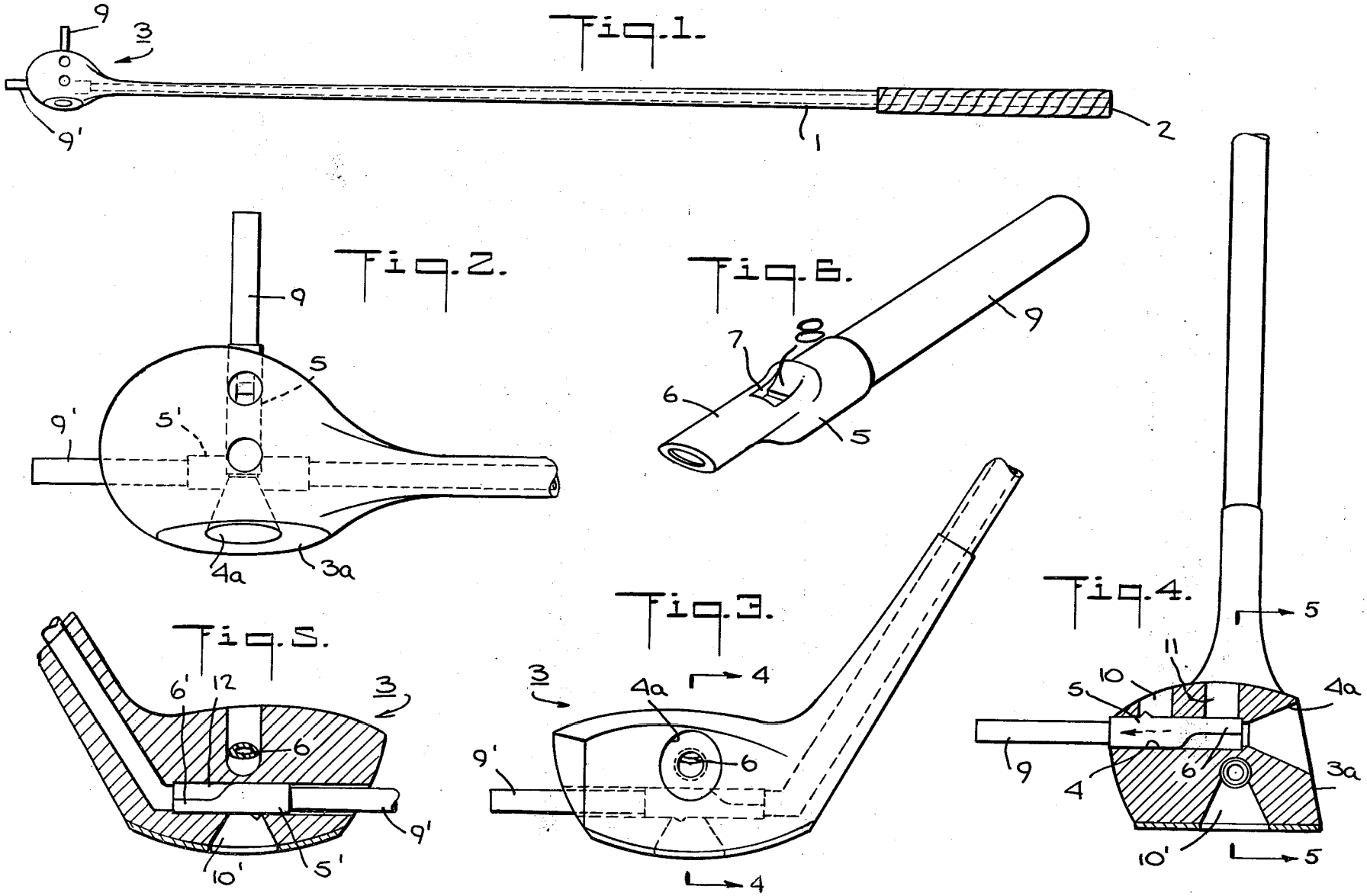
FIG. 1 is a top view of the club head and its shaft.
FIG. 2 on an enlarged scale is a top view of the club head.
FIG. 3 is a front view of the club head as shown in FIG. 2.
FIG. 4 is a cross-section taken on the line A—A in FIG. 3.
FIG. 5 is a longitudinal cross-section taken on the line 5—5 in FIG. 4.
FIG. 6 is a perspective view showing on an enlarged scale the whistle and tailpipe.

In these drawings the tubular shaft 1 can be and preferably is the same shaft usually used, excepting that its upper end 2 is open to the ambient air. The wood head 3 can simulate as exactly as is practical the head of a good driver.

The first air flow hole through the head is shown at 4, in this case having a forwardly flared inlet end 4*a* serving to capture a larger quantity of air compressed from the ambient air during the swinging action. The hole is shown as opening from the face 3*a* of the wood, the normal ball hitting face, and as extending straight backwardly substantially tangential to the arc with which the head 3 travels when swung via its shaft 1, the arc radius depending on the shaft's length and the normal grip of the golfer. Substantial tangential arrangement is effective, precision being unnecessary.

The whistle used is preferably a flageolet mouthpiece whistle shown in FIGS. 4 and 6 as being an integral plastic molding having a hollow cylindrical pipe 5 tapering forwardly to a mouthpiece 6, the pipe 5 having a side opening 7 while the tubular wall forms in this opening a forwardly depending blade 8 which causes vibration of air flow in the part 5. The tailpipe is shown at 9 and may consist of a piece of standard plastic tubing frictionally pushed into the back or air outlet end of the body 5 of the whistle.

To provide the necessary air communication with the opening 7 of the whistle, the wood head has a passage 10 which extends right angularly from the hole 4 to the club's top.

The whistle described is essentially a musical instrument, and if replaced, its replacement should also be of good quality having a similar predictable purity of tone and sound volume dependent on the velocity of the air blown through its air inlet.

Using the described whistle, and with the head 3 having the characteristic aerodynamic properties of a working wood head, it has been satisfactory to extend the tailpipe 9 for approximately two inches behind the back of the wood simulation. This has been found to provide a signal tone of excellent quality, with subtle variations depending on the uniformity and velocity of the club swing, and free from erratic acoustics having no connection with the swing characteristics.

Although the described whistle is tuned to the key of G and responds to that key when blown by a trained flageolet musician, it has been found that its sound increases not only in intensity but with an increasing pitch dependent on the swing velocity of the head. However, because the whistle is a tuned musical instrument, its change in intensity and pitch is smooth and responsive to a nice uniform club swing. In effect, music is produced and the user of the club inherently detects it as such. With practice he becomes accustomed to a smooth uniform increase in intensity and pitch which then gradually dies away during the user's follow-through. An erratic swing is immediately detectable, just as the user can detect a sour note when listening to music. The user instinctively attempts to obtain sweet music, and in so doing he obtains a swing that is perfect as to uniformity or smoothness and which he can gradually increase in velocity.

Using any conventionally shaped whistle, there is a possibility for turbulence to occur between the inside of the hole 4 and around the mouthpiece 6 or its equivalent. It has been found that this possibly interferes with the musical sound of which a whistle of sound acoustical design is capable. This possibility of trouble is avoided by a second passageway 11 which is formed through the wood to connect the hole 4 with the ambient air at the top of the wood and at a location about at or a little behind the front end of the whistle, namely, its mouthpiece or air inlet. This assures the whistle receiving only the air pressure dependent on the swinging velocity of the simulated wood head.

Emphasis has been placed hereinabove on the use of this trainer by the more serious adult golfer. However, with less attention paid to exact balance, size and the like required in connection with such an adult user, the present invention provides the possibility of making an inexpensive device which some might call a toy, but which in the hands of a child or youth can instill the inherent desire to produce a sweet musical note when swinging what might otherwise be called a toy club simulation.

To accommodate the second whistle to provide an even greater sound output when the club is swung, the head is formed with a second hole 12, and a second whistle, numeraled as before but with the numerals primed, duplicating the first whistle in construction, is positioned in this hole 12. The first hole 4 is now formed at a somewhat higher level than before, and it extends longitudinally straight through the club head from the face of the club to its back side as previously indicated.

This second hole 12 extends transversely in the club head at a level just below that of the hole 4. The two holes 4 and 12 are positioned at right angles to each other, the whistle being positioned in the hole 12 as shown by FIG. 5 with its tailpipe 9' extending from the mouth of the hole 12 but for a smaller distance than the tailpipe 9 extends, although the same distance from the whistle as before. It is desirable that both flageolet mouth pieces have the same pitch, and since the tailpipe effects the pitch, the two tailpipes are given the same length. The turbulence around the side of the club head is not of the same extent as that occurring behind the head, so the shorter external projection length of the tailpipe of the second whistle provides the same action as that of the first.

Being transverse to the swinging direction of the club head, the pressure of the air compressed by the club head swing is not available for use by this second whistle.

The second whistle's pressurized air is, however, provided by the tubular shaft 1 with its open end 2, the lower end of the shaft being connected to the inlet end of this second hole 12. When the club is swung, the air in the shaft 1 is centrifugally driven into the inlet end of the hole 12 and through the whistle's mouthpiece. Because of this arrangement, the relief hole 11 is not needed in this case, a downwardly extending hole 10' opening into the hole 12 providing the necessary function of the hole 10 of the first whistle.

With the present improvement on the original construction, swinging of the golf club results in an acoustical output that is at least twice as great as that obtained before. The tone remains as pure as before and is not detectable as coming from two whistles, the two whistles being duplicates and forming a pair. The second whistle in its hole 12 is inverted as compared to the upright position of the whistle in the hole 4, but this does not alter its pitch.

Although duplicate whistles are preferred at present, it can be seen that the whistles may be differently pitched. Flageolet mouthpieces are obtainable with differing pitches, and if desired, differently pitched whistles can be used if found to provide the new club with a greater appeal to the purchasing public. Maximum intensity of sound is obtained when the two whistles have the same pitch.

Conventional golf club shafts are tubular, but normally have closed upper ends. In the case of the present invention, the upper end must be left open to the ambient atmosphere so that the centrifugally displaced air can be fed via the shaft's upper end.

The first hole 4 with its mouth **4*a* opening through the face of the club interferes with the use of the club for actually hitting a golf ball. The second whistle in the hole 12 obtains a good feed of pressurized air via the shaft when the club is swung, and it alone provides a sound output that may be adequate in some instances, particularly when the club is swung in the absence of excessive background noise. Consequently, the hole 4** and its whistle can be eliminated so that the club has a solid ball-striking face and can be used to hit a golf ball while simultaneously providing an audible signal indicating the precision and velocity of the club's swing.

The action of the first whistle when used, is dependent on the compression of the air by the motion of the face of the club head and is, therefore, dependent on the velocity and smoothness with which the club is swung. In the case of the second whistle, it likewise responds by its tone and intensity to the swinging velocity of the club because the centrifugal displacement of air in the shaft 1 is also dependent on the velocity and smoothness of the golfer's swing.

Using both whistle's pitched the same, a very intense acoustical output is obtained. The sound can be heard for a hundred yards or more, making this improved golf club an effective golfer's swing trainer practically regardless of the background noise level.

Both holes in which the whistles are installed are straight, and the tailpipes are in axial alignment with the whistles. The first hole extends straight through the head from its face to its back, and in this case the tailpipe extends straight back from the head's back in axial alignment with the hole. Air flow through the hole and whistle is substantially free from impedance. The second hole 12 likewise extends straight from its inlet end to which the shaft's lower end is connected, this hole extending transversely through the golf club head with its outlet opening to the side of the head opposite to the shaft, and its tailpipe extends straight from this transverse hole's outlet end in axial alignment with the hole. In this case also, the air flow is relatively unimpeded.

The two holes 4 and 12 are positioned at different levels and close together, it being unimportant if to get the holes close together they radially open to each other slightly where they cross each other.

In addition to its usefulness as a trainer, this improved new club with its extending tailpipes provides a novel visual appearance contributing to its sales appeal. It looks like what it is, a scientifically designed golfer's swing training tool.

I claim:

1. A golf club comprising a shaft, a head mounted by said shaft and formed with an air flow hole having inlet and outlet ends, a whistle in said hole and actuated by air flow through the hole, means actuated by swinging of said club for forcing air into said inlet end, said outlet end being open to the ambient air and said swinging forming localized air turbulence in the ambient air at said outlet end, and a tailpipe extending from said outlet end to a position where the ambient air is relatively free from said turbulence.

2. The golf club of claim 1 in which said means comprises said club having a front face and said inlet end positioned to open through said face so as to receive pressurized air from the ambient air compressed in front of said face by swinging of said club.

3. The golf club of claim 1 in which said means comprises said shaft being tubular and having an upper end open to the ambient air and a lower end connected to said inlet end so as to receive pressurized air centrifugally driven from said shaft by swinging of said club.

4. The golf club of claim 2 in which said hole extends through said head from its said face to its back and said tailpipe extends from said back in axial alignment with said hole.

5. The golf club of claim 3 in which said hole extends from its said inlet end to which the shaft's said lower end is connected, transversely through said head with the hole's said outlet opening through the side of said head opposite to said shaft, said tailpipe extending from said outlet end in axial alignment with said hole.

6. The golf ciub of claim 2 in which said head has a second hole having inlet and outlet ends and containing a whistle actuated by air flow through said second hole, said shaft being tubular and having an upper end open to the ambient air and a lower end connected to the second hole's said inlet end so as to receive pressurized air centrifugally driven from said shaft by swinging of said club, said second hole extending through said head transversely and at a different level with respect to the first-named hole, the second hole's said outlet end being open to the ambient air.

7. The golf club of claim 6 in which said localized turbulence is also formed at the second hole's said outlet end and a tailpipe extends from the latter to a position where the ambient air is relatively free from said turbulence.

* * * * *